United States Patent [19]

Snodgrass et al.

[11] 4,004,496

[45] Jan. 25, 1977

[54] M16A1 BURST CONTROL

[75] Inventors: Robert E. Snodgrass, Bettendorf, Iowa; Michael N. Tyler, Illinois City, Ill.

[73] Assignee: The United States of America as represented by the Secretary of the Army, Washington, D.C.

[22] Filed: May 28, 1976

[21] Appl. No.: 691,190

[52] U.S. Cl. ..... 89/129 B
[51] Int. Cl.[2] ..... F41D 11/10
[58] Field of Search ..... 89/129 B

[56] References Cited

UNITED STATES PATENTS 3,774,500 11/1973 Into ..... 89/129 B

*Primary Examiner*—Stephen C. Bentley
*Attorney, Agent, or Firm*—Nathan Edelberg; Harold H. Card, Jr.; Robert O. Richardson

[57] ABSTRACT

An automatically recyclable burst control mechanism for weapon systems which is responsive to trigger action to actuate automatic recycling of the burst control mechanism to its initial position, independent of the number of rounds fired in each preceding automatic burst.

11 Claims, 4 Drawing Figures

M16A1 BURST CONTROL

The invention described herein may be manufactured and/or used by or for the Government for governmental purposes without the payment of any royalty thereon.

BACKGROUND OF THE INVENTION

Heretofore, many attempts have been made to design burst firing mechanisms for weapon systems. However, the primary disadvantage of these systems has been that these mechanisms have been unreliable in automatically determining, independent of the user, whether all rounds of each programmed burst have been fired. Thus, these prior art mechanisms would automatically cycle through to complete the programmed burst before a new burst cycle could be initiated. For example, if the second shot of a three shot burst misfired, the prior art mechanisms would complete the third shot of the cycle before a new three round burst could be initiated. This problem is even more pronounced if the weapon is magazine fed. Assume the ammunition is depleted before the final shot in a burst. The user inserts a new clip or magazine expecting to fire a complete three round burst. Instead, only the final shot in the existing burst cycle is fired. The user, anticipating a burst cycle target situation, therefore, with these prior art mechanisms cannot rely on the weapon to accomodate the burst target situation instantaneously and will waste ammunition by manually charging the weapon to cycle the weapon to the point of initiation of a new burst cycle.

SUMMARY OF THE INVENTION

These and other problems, difficulties, and disadvantages of the prior art are substantially overcome by utilization of the burst control assembly of the present invention which automatically and, independent of the user, recycles to initiate another full burst in response to trigger action, regardless of the number of rounds fired in the preceding burst.

The recycling burst control assembly of the present invention includes a bolt carrier actuated burst sear controlling operation of a rachet pawl to step a rachet wheel which in turn pivots the hammer disconnect to release the hammer. The number of shots in each burst is determined by the number of rachet teeth on the wheel minus one. The wheel has a dwell time segment, so that, after the predetermined number of shots in the burst corresponding to the number of teeth on the wheel have fired, the rachet pawl does not turn the wheel and, thus, the disconnect does not release the hammer indicating to the user that the burst has been completed.

Upon release of the trigger, the disconnect is pivoted from engatement with the wheel and then spring biasing means automatically return the wheel to its initial position, so that the predetermined number of shots in a burst will be fired upon the next pull on the trigger. Thus if a misfire occurs or a magazine is emptied prior to completion of a burst, the user is confident that releasing of the trigger will automatically reset the rachet wheel to permit firing of a full burst on the next pull on the trigger.

DESCRIPTION OF DRAWING

These and other objects, features, and advantages of the present invention will become readily apparent to one skilled in the art from a reading of the following description of a preferred embodiment of the present invention, when read in conjunction with the accompanying drawing, wherein like reference numerals refer to like and corresponding parts throughout the several views and wherein.

DESCRIPTION OF A PREFERRED EMBODIMENT

Figure 1:
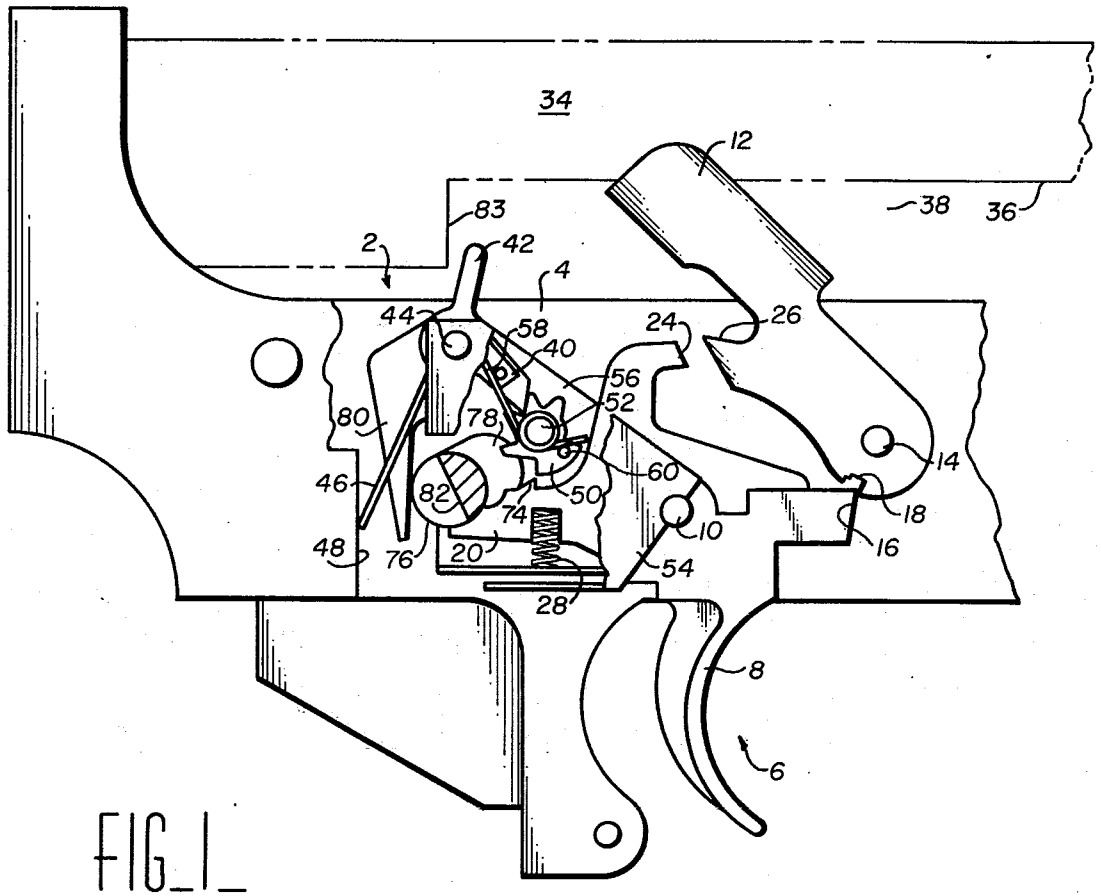
FIG. 1 is a side view in elevation of a receiver and bolt carrier of a rifle which is partially broken away and which illustrates the present invention in the burst mode just prior to firing of the first shot in a three shot burst.

Referring to FIG. 1 there is illustrated a segment of a rifle having a receiver 2 defining a housing 4 for the trigger assembly, generally indicated by the numeral 6.

The trigger assembly includes a trigger 8 pivoted on a pin 10 carried by the receiver 2 and a hammer 12 pivoted on a pin 14 also carried by the receiver 2. The trigger mounts the primary sear 16 which is seatable in a primary sear notch 18 in the hammer 12.

A disconnect 20 is pivoted on the pin 10 and is disposed in a longitudinal axial recess 22 (FIG. 4) in the trigger body 8 for pivotable movement therewith. The disconnect 20 carries a secondary sear 24 which is seatable in a secondary sear notch 26 formed in the hammer 12. Spring means 28 bias the disconnect sear 24 to its sear latching position. Spring means 30 (FIG. 4) bias the hammer 12 to the firing position and spring mean 32 (FIG. 4) bias the trigger to its normal inactive position.

The trigger assembly 6, as described, is conventional in structure and operation in the semi-automatic mode.

Figure 2:
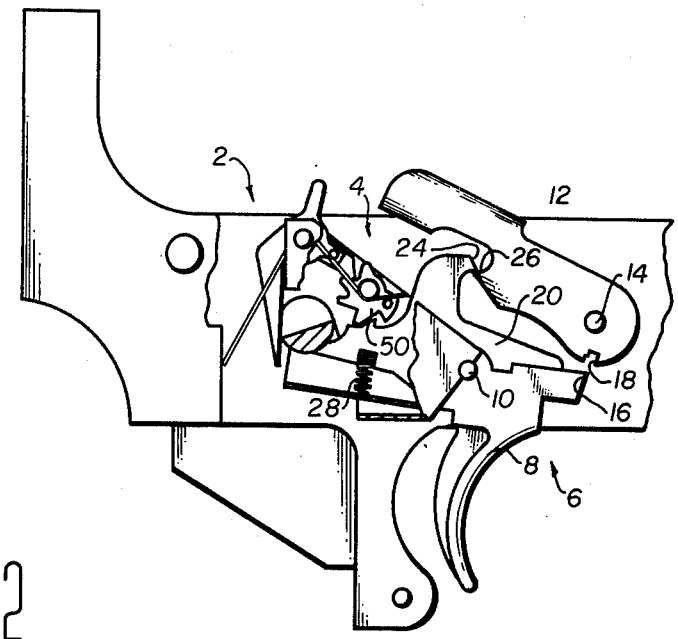
FIG. 2 illustrates the positions of the wheel, disconnect and burst sear after firing in the semi-automatic mode.

In the semi-automatic mode when the trigger is pulled against the bias of spring means 32 and is pivoted clockwise, the primary sear 16 disengages from the hammer 12 and the bias of spring means 30 impacts the hammer 12 against the firing pin (not shown). Return of the hammer, after firing, to its cocked position (FIG. 1) is bolt carrier actuated. When the bolt carrier 34 recoils, a surface 36 in a bolt carrier recess 38 contacts the hammer 12 and pivots the hammer counterclockwise to return the hammer 12 against the bias of spring means 30 to its cocked position (FIG. 2). The secondary sear 24 then seats in sear notch 26 and primary seat 16 seats in notch 18 to hold the hammer in the cocked position ready for the next pull of the trigger.

In accordance with the present invention a burst control assembly is provided which controls the operation of the conventional trigger assembly described above to fire sequentially a preselected number of rounds per burst, in response to the position of the trigger and regardless of the number of rounds fired in any preceding burst, and to recycle automatically the burst control assembly for initiation of a new full burst upon the next pull on the trigger.

The burst control assembly of the present invention includes a pivotable burst rachet pawl 40 carrying a burst sear device 42. The pawl device 40 is pivotably movable on a pin 44 which is carried in the receiver housing 4 and secured to the walls thereof. Spring means 46 bearing against the sear device 42 and an internal receiver housing shoulder 48 bias the sear device 42 to the burst mode position shown in FIG. 1.

Figure 3:
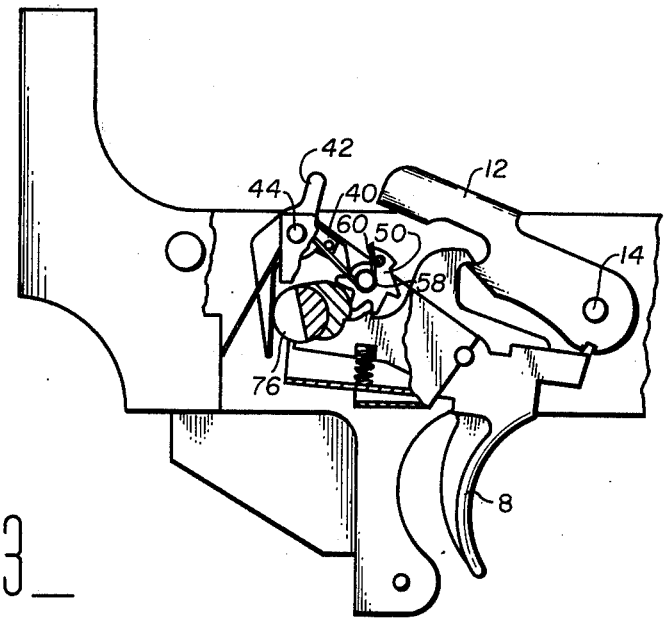
FIG. 3 is similar to FIG. 1 but illustrates the positions of the wheel and disconnect just after to firing of the third shot in the burst.

The ratchet pawl 40 is provided to impart counterclockwise movement to a rotatable rachet wheel 50. In the embodiment of FIGS. 1–3, the wheel 50 is rotatably mounted on a shaft 52 and is carried between a pair of spaced supporting arms 54 and 56, each of which is supported at one end on the sear device pin or shaft 44 and at its other end on the trigger pin 10.

Spring means 58 bearing at one end against sear device pin 44 and at its other end against a projection 60 carried by the wheel 50 biases the wheel to its initial position shown in FIG. 1.

In the embodiment shown in FIGS. 1–3, the burst control assembly is programmed for a three shot burst on each pull on the trigger. To this end, the ratchet wheel 50 is provided with two spaced crown teeth 62 (FIG. 4) and 64 (FIG. 4) which are in position for counterclockwise stepping by engatement by the pawl 40.

To facilitate riding of the pawl 40 over the teeth 62 and 64, the pawl may be provided with a separate engagement head 66 (FIG. 4) which is biased by spring means 68 (FIG. 4) counterclockwise. Each tooth 62 and 64 has a companion locking lug 70 (FIG. 4) and 72 (FIG. 4) respectively which cooperates with a stop projection 74 carried by the disconnect 20 in the embodiment shown in FIGS. 1–3 to prevent clockwise movement of the wheel 50 under the influence of spring means 58 after each independent, sequential stepping movement of the teeth 62 and 64.

In accordance with the present invention, the conventional firing mode selector 76 is provided with an additional cam surface 78 (FIG. 1). The burst sear device 42 is provided with an extension arm 80 which is camed by the selector cam surface 78 to the inactive burst firing position shown by the dotted line in FIG. 1. In this position, other firing modes of the weapon can be accomplished, and the bolt carrier 34 is free to recoil and counterrecoil without engagement with or activation of the burst sear device 42. However, upon rotation of the selector 76 to the burst firing mode position, the sear extension arm 80 is moved into the selector recess slot 82. Then the sear device 42 is held only under the bias of spring means 46 in engagement with the bolt carrier recess surface 83 against counterclodkwise movement.

With the sear device 42 now in the recess 38 bearing against surface 83 of the bolt carrier 34 and with the wheel 50 in its initial position shown in full lines in FIG. 1, the weapon is now ready for a full three shot burst firing.

When the trigger 8 is pulled, it pivots clockwise and the primary sear 16 pivots out of the sear notch 18 releasing the hammer 12 which in turn pivots clockwise to strike the firing pin (not shown).

The round is fired and the bolt carrier 34 recoils thereby engaging and pivoting the hammer counterclockwise to its cocked position where the secondary sear 24 engages in the secondary sear notch 26. Continued depression of the trigger maintains the primary sear 16 out of latching position with the primary sear notch 18 or in an inactive position during the burst.

As the bolt carrier 34 continues its recoil movement, the burst sear 42 pivots counterclockwise under the influence of spring means 46 to position the pawl 40 for contacting the tooth 62 to step the ratchet wheel 50.

Upon commencement of the counterrecoil movement of the bolt carrier 34, the bolt carrier surface 36 engages the burst sear device 42 to pivot it clockwise. The pawl 40 is thereby pivoted clockwise for engagement with the rachet wheel tooth 62 to initiate movement of the rachet wheel 50 one step from its initial position. While the pawl 40 is rotating the wheel 50, the locking lug 72 of the moving rachet wheel in engagement with the sloped surface of the disconnect stop projection 74 is camming the disconnect 20 to pivot it counterclockwise. Such pivoting of the disconnect 20 disengages the secondary sear 24 from the secondary sear notch 26 and releases the hammer to fire the second shot in the burst. While the hammer is moving to its firing position to fire the second shot and the burst sear 42 is moving to its initial position, the locking lug 72 disengages from the shaped surface of stop 74 permitting the disconnect spring means 28 to return the disconnect carried secondary sear 24 to the cocked position ready to latch the hammer in the cocked position for firing of the third shot in the burst cycle.

After the disconnect has been pivoted so that the secondary sear is in the cocked position, the locking lug 72 engages behind the stop 74 so that the disconnect spring means 28 and engagement of lug 70 and stop 74 prevent the ratchet wheel spring means 58 from rotating the wheel 50 during firing of the third shot in the burst series.

The third shot is then fired.

The sequencing of the operation of the burst control assembly in automatically firing the third shot in the burst is similar to the above described firing operation of the second shot except that the pawl 40 engages the second ratchet tooth 64 to rotate the wheel 50 clockwise and the second lug 70 engages and latches the stop 74.

After the third shot has been fired and with the secondary sear 24 in the hammer sear notch 26 holding the hammer in the cocked position, the burst sear 42 is again pivoted by the bolt carrier 34. However because there are no additional teeth on the ratchet wheel 50 to be engaged by the pawl 40, to rotate the wheel (in a three burst cycle), the wheel does not rotate to engage a third lug with the stop 74. Consequently, the secondary sear 24 remains in the sear notch 26 to latch the hammer in the cocked position and the lug 70 and disconnector stop 74 remain in engagement to prevent counterclockwise rotation of the wheel 50 under the influence of spring means 58. Since the hammer does not move, the gunner will know that the burst has been completed. Upon release of the trigger after the burst has been fired, the pivoting trigger, in returning to its inactive position, pivots the disconnect counterclockwise disengaging the lug 70 from the disconnect stop 74 allowing spring means 58 to return the ratchet wheel 50 to its initial position shown in full line in FIG. 1 ready to initiate firing of another three shot burst.

The bolt carrier has completed its third counter recoil movement and holds the sear device against the bias of the spring means 46 also in readiness for the next three round burst.

Figure 4:
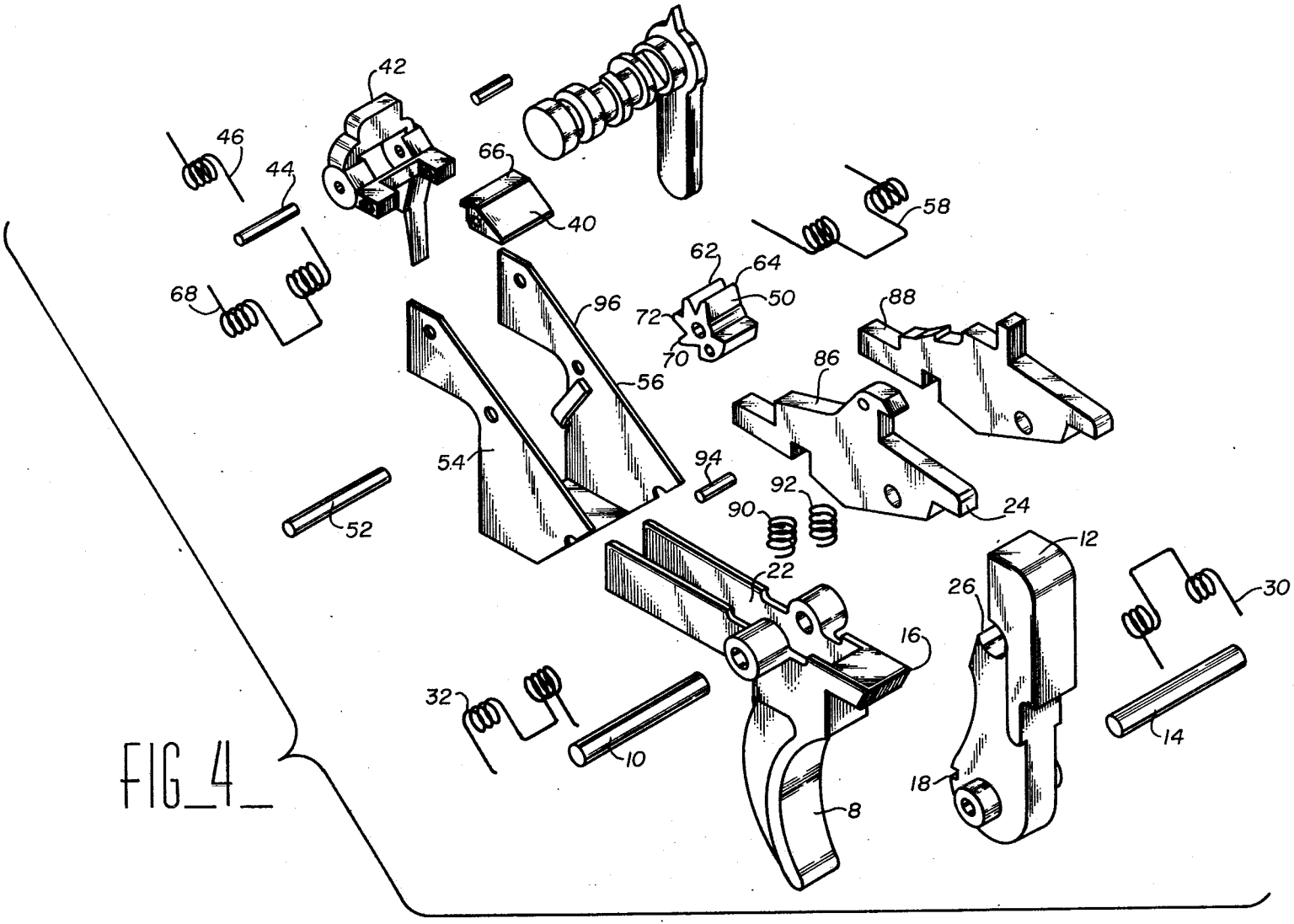
FIG. 4 is an exploded view of a second embodiment of a burst control mechanism having some parts interchangable with corresponding parts of the embodiment of FIGS. 1 and 3.

An alternative embodiment is shown in FIG. 4.

In this embodiment, the disconnect 24 comprises two spaced members 86 and 88 separated by and disposed in the recess 22 of the trigger 8 for pivotable movement together under the influence of spring means 28 and of the pivotable movement of the trigger 8.

In this embodiment, one of the members 86 and 88 carries the secondary sear 24 and the other carries the stop 74. Spring means 28 in this embodiment comprises a pair of spaced springs 90 and 92, one for each of the disconnect members 86 and 88 which perform the same functions and operations as the spring means 28 in the embodiment of FIGS. 1–3. A pin 94 is utilized to tie the members 86 and 88 together for releasing the hammer when the stop is rotated counterclockwise. The supporting arms 54 and 56 in this embodiment are repalced by a unitary bracket 96.

In all other respects, the structure and operation of the embodiment of FIG. 3 correspond to those of the embodiment of FIGS. 1–3.

It will be appreciated that cycles of two or more bursts may be accomplished by the expedient of programming more teeth on the ratchet wheel 50.

It is to be understood that, although preferred embodiments of the present invention has been shown and described herein, the present invention is not limited thereto, because variations and other embodiments will become readily apparent to those skilled in the art from the foregoing description. Accordingly, the present invention should be considered limited only by the scope of the following claims.

I claim:

1. In a firearm having a receiver including a receiver housing, a pivotable trigger having a primary sear, a disconnect pivotably carried in the housing by the trigger and having a secondary sear, a pivotable hammer in the housing having primary and secondary sear receiving notches to latch the hammer in a cocked position, means normally biasing said disconnect and the secondary sear to a latching position in said seondary sear notch, and recoiling parts, the improvement comprising a burst control assembly in said housing for automatic firing of a preselected number of shots in a burst, said assembly including:

a burst sear device pivotable between a first inactive position and a second pawl activating position, means for biasing said burst sear device to said first position, means carried by said recoiling parts for moving said burst sear device from said first position to said second position during counter-recoil movement of said recoiling parts, a pawl carried by said burst sear device for pivotable movement therewith as the burst sear device moves between said positions, a ratchet wheel in said housing in position for rotation thereof by said pawl a predetermined distance from an initial position each time the burst sear device moves from said first position to said second position, means carried by the rachet wheel for pivoting said disconnect against the bias of said disconnect biasing means to unlatch said secondary sear from said secondary sear notch each time said ratchet wheel is rotated to permit the hammer to move to its firing position, and means carried by the wheel for automatically returning the wheel to its initial position each time the trigger is pivoted from a firing position to an inactive position.

2. The burst control assembly of claim 1 including means carried by said wheel for engagement with said disconnect to prevent said wheel return means from returning the wheel to its initial position until the trigger is pivoted from said firing position to said inactive position.

3. The burst control assembly of claim 1 including a selector for varying the firing mode of the firearm, said selector being engageable with said burst sear device to pivot the burst sear device to a third position to prevent engagement of the recoiling parts with said burst sear device and thereby to inactivate operation of the burst control assembly.

4. The burst control assembly of claim 2 including a selector for varying the firing mode of the firearm, said selector being engageable with said burst sear device to pivot the burst sear device to a third position to prevent engagement of the recoiling parts with said burst sear device and thereby to inactivate operation of the burst control assembly.

5. The burst control assembly of clam 3 wherein the selector is rotatable and has a cam surface for engagement with an arm extension carried by the burst sear device to move the burst sear device to said third inactive position.

6. The burst control assembly of claim 5 wherein said ratchet wheel has a plurality of spaced pawl engageable teeth corresponding in number minus one to the preselected number of shots to be fired in each burst and each tooth has a corresponding locking lug on the wheel for engagement with a stop on the disconnect for pivoting the disconnect to release the hammer and to thereafter cooperate with the stop to prevent return movement of the wheel under the influence of said wheel return means until the trigger is returned to its inactive position.

7. The burst control assembly of claim 6 wherein the wheel has a peripheral surface adjacent the final tooth which is nonengageable by the pawl to rotate the wheel to pivot the disconnect and release the hammer.

8. The burst control assembly of claim 7 wherein said wheel return means is spring means.

9. The burst control assembly of claim 8 wherein said wheel has two teeth to provide a three round burst cycle.

10. The burst control assembly of claim 8 wherein the reciprocating parts is a bolt carrier having a recess in which the burst sear device is extendible for pivoting movement from said first position to said second position during counterrecoil movement of said bolt carrier.

11. The assembly of claim 10 wherein said disconnect stop has a sloped leading surface for engagement by said locking lugs communicating with a vertically extending surface for engagement by said locking lugs to prevent return movement of said wheel.

* * * * *